US005144279A

United States Patent [19]

Yajima et al.

[11] Patent Number: 5,144,279

[45] Date of Patent: Sep. 1, 1992

[54] RESISTOR ELEMENT WITH THIN POROUS METALLIC LAYER COVERED WITH GLASS COATING

[75] Inventors: Yasuhito Yajima; Hiroshi Nakajima, both of Nagoya, Japan

[73] Assignee: NGK Insulators, Inc., Japan

[21] Appl. No.: 705,652

[22] Filed: May 24, 1991

[51] Int. Cl.[5] ..... H01C 1/02

[52] U.S. Cl. ..... 338/270; 338/271; 338/273; 338/275; 338/276

[58] Field of Search ..... 338/270, 271, 273, 275, 338/276; 204/192.21

[56] References Cited

U.S. PATENT DOCUMENTS 4,887,462 12/1989 Gneiss ..... 73/118.2
4,903,001 2/1990 Kikuchi ..... 338/22 R
4,909,079 3/1990 Nishimura et al. ..... 338/25
4,911,009 3/1990 Maeda et al. ..... 73/204.25
4,920,635 5/1990 Yajima ..... 29/612

FOREIGN PATENT DOCUMENTS 60-60521 4/1985 Japan .

*Primary Examiner*—Marvin M. Lateef
*Attorney, Agent, or Firm*—Parkhurst, Wendel & Rossi

[57] ABSTRACT

A resistor element for determining a parameter, which includes a ceramic support having a bearing surface, an electrically resistive metallic layer formed on the bearing surface of the ceramic support, and a glass coating covering the metallic layer. The metallic layer has a plurality of pores which extend from an outer surface of the metallic layer to the bearing surface of the ceramic support, each pore having an area which is not smaller than that of a circle having a diameter of 1 μm. An average spacing between adjacent ones of the pores is not larger than 5 μm.

8 Claims, 3 Drawing Sheets

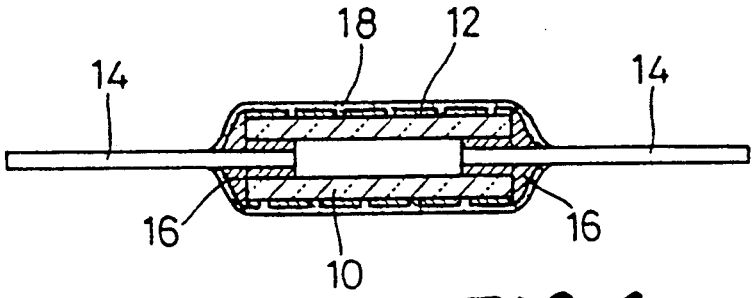
FIG. 1
FIG. 2
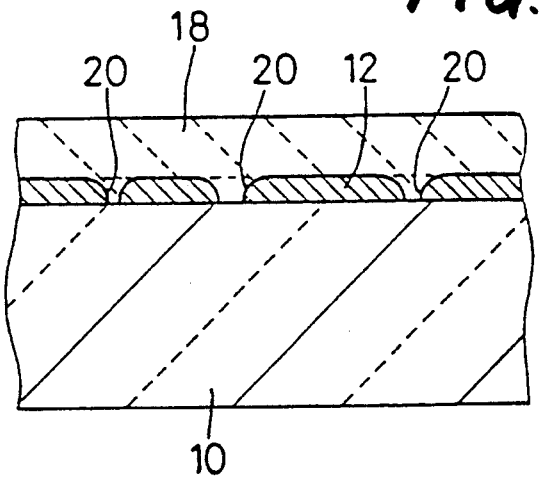

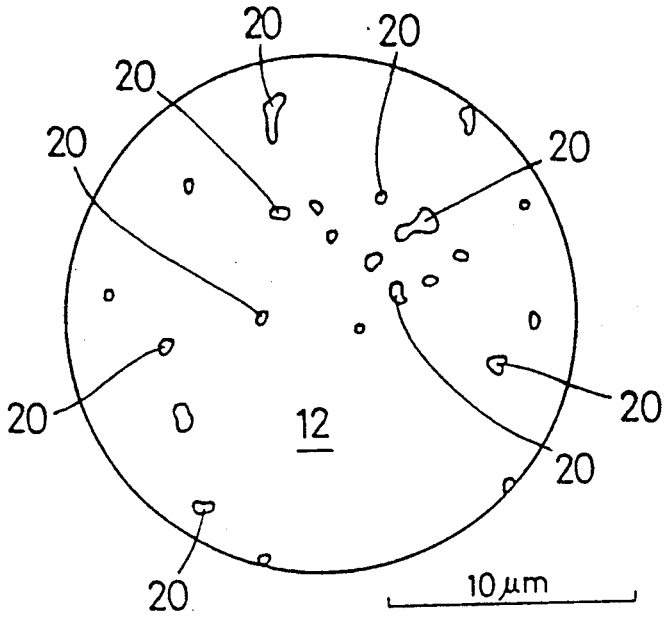
FIG. 3(a)
FIG. 3(b)
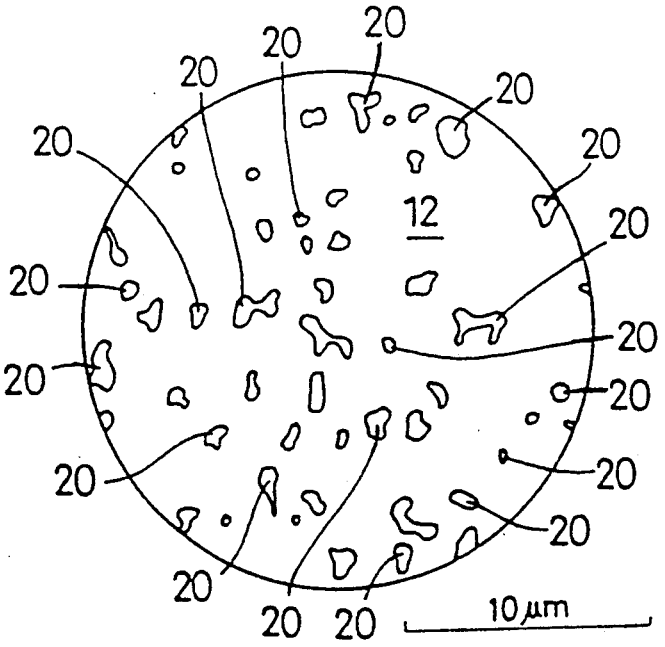

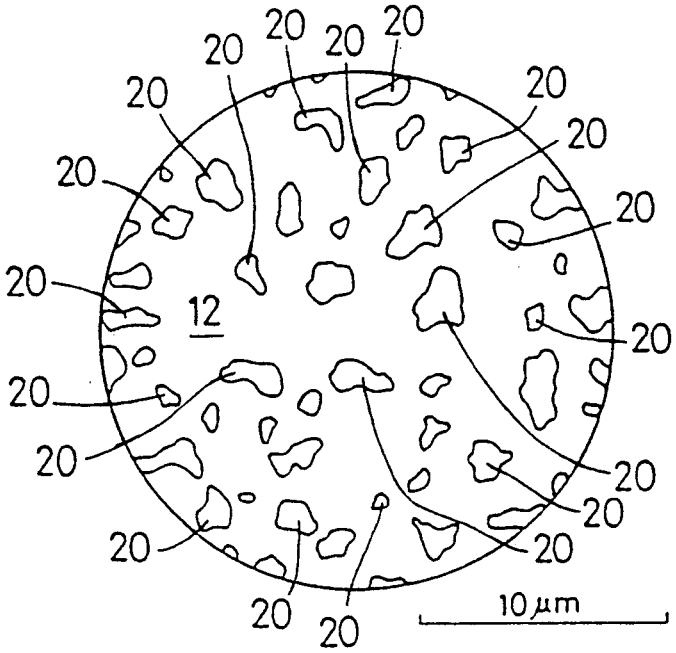
FIG. 3(c)
FIG. 3(d)
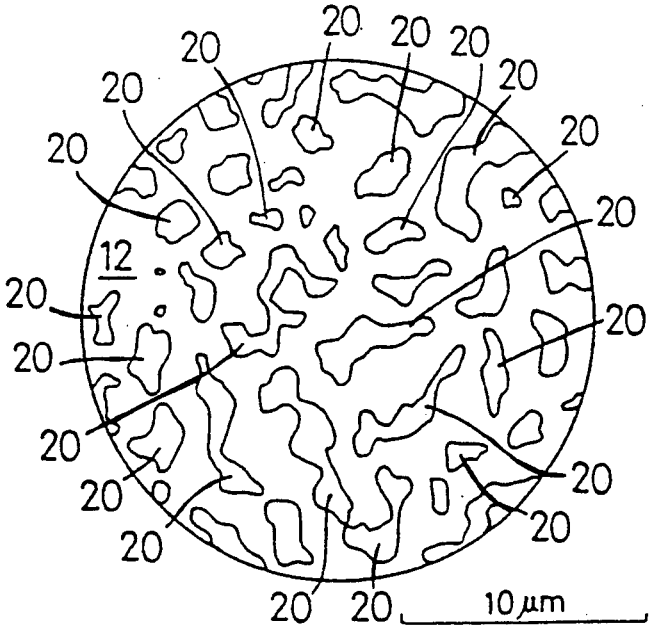

RESISTOR ELEMENT WITH THIN POROUS METALLIC LAYER COVERED WITH GLASS COATING

BACKGROUND OF THE INVENTION

1. Field of the Art

The present invention relates in general to a resistor element having a thin electrically resistive film, and more particularly to such a resistor element which is suitably used as a detecting element for a temperature sensor or a thermal flow meter, for example.

1. Discussion of the Prior Art

A resistor element which uses a thin metallic film as an electrically resistive body is known. The resistor element is adapted to electrically detect the temperature of a fluid, for example, by utilizing temperature dependence of an electrical resistance of the metallic film. An example of the resistor element is disclosed in laid-open Publication No. 60-60521 of unexamined Japanese Patent Application. This resistor element includes an electrically insulating ceramic support on which the electrically resistive metallic film is formed, and a protective glass coating covering the outer surface of the metallic film. The resistor element of this type is suitably used as a detecting element for a temperature sensor or a thermal flow meter, for example.

The resistor element of the above type is often subjected to a considerably high temperature during use, due to heat generated by the element itself, or heat transferred from the surrounding atmosphere. In view of this situation, the electrically resistive film is formed of a metal such as platinum, rhodium, palladium, gold, silver and nickel, or an alloy thereof. This metallic film is applied to a bearing surface of the ceramic support, in a physical or chemical method such as sputtering, chemical vapor deposition (CVD), vacuum evaporation, and plating. The applied metallic film is then trimmed by a laser as needed, so that the metallic film is formed in a suitable pattern, e.g. in a spiral or a zigzag pattern. The thus formed film has a predetermined value of electrical resistance.

The metallic film is made of a material which is unlikely to be oxidized, while the glass coating formed on the outer surface of the metallic film is formed of an oxide, whereby the glass coating has a relatively low affinity for the metallic film. When a glass material is heat-treated or fused to form the glass coating on the metallic film, the fused glass tends to be repelled from the metallic film because of the low affinity therebetween. As a result, the glass coating is not able to cover the entire area of the outer surface of the metallic film.

Further, when the metallic film is formed on the ceramic support, air may be trapped between the film and the ceramic support, resulting in poor adhesion of the film to the bearing surface of the support. In addition, the metallic film made of the above-described material also has a relatively low affinity for the ceramic support formed of an oxide such as alumina, and therefore suffers from a low degree of bonding strength with respect to the ceramic support. As stated above, the glass coating formed on the outer surface of the metallic film is also formed of an oxide, and has a relatively low affinity for the metallic film. Accordingly, it has been rather difficult to assure sufficient bonding strength between the glass coating and the metallic film.

In the resistor element as described above, the metallic film and the glass coating suffer from cracks, or separation or flake-off from the ceramic support or the metallic film, due to thermal stresses caused by repetitive temperature changes during use of the element. Thus, the conventional resistor element is not satisfactory in its durability.

SUMMARY OF THE INVENTION

The present invention was developed in the light of the above circumstances of the prior art. It is therefore an object of the invention to provide an improved resistor element wherein the glass coating is effectively prevented from being repelled from the metallic layer, and the metallic film and the glass coating firmly adhere to the ceramic support with increased bonding strength, assuring high degrees of durability and reliability of the element.

The above object may be accomplished according to the principle of the present invention, which provides a resistor element for determining a parameter, comprising: (a) a ceramic support having a bearing surface; (b) an electrically resistive metallic layer formed on the bearing surface of the ceramic support, the metallic layer having a plurality of pores which extend from an outer surface of the metallic layer to the bearing surface of the ceramic support, each of the pores having an area which is not smaller than that of a circle having a diameter of 1$\mu$m, an average spacing between adjacent pores being not larger than 5$\mu$m; and (c) a glass coating covering the metallic layer.

In the resistor element constructed according to the present invention, residual air trapped between the ceramic support and the metallic layer during formation of the latter can be expelled through the pores formed through the metallic layer, upon heat application during formation of the glass coating. Accordingly, the metallic layer is effectively sintered with the ceramic support, assuring a significantly increased bonding strength therebetween.

In the resistor element of the invention, the glass material of the glass coating fills the plurality of pores formed through the metallic layer, so that the glass coating is securely anchored at its portions filling the pores, to the ceramic support which has a relatively high affinity for the glass coating. In this arrangement, the glass coating is effectively prevented from being repelled from the metallic layer, whereby the entire surface area of the metallic layer is covered with the glass coating. With the metallic layer sandwiched by and between the glass coating and the ceramic support, the bonding strength between the metallic layer and the ceramic support is also significantly improved.

According to the present invention, therefore, the metallic layer and the glass coating firmly adhere to the ceramic support with considerably high bonding strength, assuring excellent durability of the resistor element.

BRIEF DESCRIPTION OF THE DRAWINGS

The foregoing and other objects, features and advantages of the present invention will be better understood by reading the following detailed description of a presently preferred embodiment of the invention, when considered in connection with the accompanying drawings, in which:

FIG. 1 is a schematic elevational view in longitudinal cross section of one embodiment of a resistor element of the present invention;

FIG. 2 is a fragmentary view in cross section of the resistor element of FIG. 1; and FIGS. 3(*a*), 3(*b*), 3(*c*) and 3(*d*) are views showing in enlargement respective sets of pores as observed by a microscope, which pores are formed through metallic layers formed on ceramic supports of respective experimental specimens, by heating the metallic layers at 900° C., for 10 min., 30 min., 1 hr., and 2 hrs., respectively.

DETAILED DESCRIPTION OF THE PREFERRED EMBODIMENT

Referring first to FIGS. 1 and 2, there is illustrated one embodiment of the resistor element of the present invention. In the figure, reference 10 denotes a cylindrical support formed of a ceramic material such as alumina.

The ceramic support 10 has a circumferential outer surface serving as a bearing surface, to which is secured a thin metallic layer 12 made of platinum, for example, such that the layer 12 having a suitable width is formed in a spiral. This metallic layer 12 serves as an electrically resistive body of the resistor element. More specifically, the metallic layer 12 may be formed by first applying a thin metallic film over the outer circumferential surface of the ceramic support 10, by a physical or chemical method such as sputtering, chemical vapor deposition (CVD), vacuum evaporation or plating, and then trimming the metallic film by a laser so that the spiral metallic layer 12 is defined by a spiral groove formed in the metallic film.

A pair of lead wires or electrical conductors 14 are inserted suitable distances at their end portions in respective end portions of a central bore of the cylindrical ceramic support 10. The lead wires 14 are made of an electrically conductive material such as stainless steel or platinum. These lead wires 14 are secured to the ceramic support 10 by respective connectors 16, which are formed by baking an electrically conductive paste principally made of platinum, for example. The connectors 16 also function to electrically connect the lead wires 14 to respective ends of the electrically resistive metallic layer 12.

On the outer surfaces of the ceramic support 10 on which the metallic layer 12 and the connectors 16 are formed, there is provided a protective glass coating 18 which is secured to outer surfaces of the metallic layer 12 and the connectors 16 such that the whole assembly of the ceramic support 10, metallic layer 12 and connectors 16 is covered with the glass coating 18, as shown in FIG. 1. The glass coating 18 is prepared in the following manner. A slurry containing a glass powder is first applied to the outer surface of the ceramic support 10 which bears the metallic layer 12, by dipping, blade coating or spray coating, for example. After drying the applied slurry, the glass powder is fused by heating, to provide the glass coating 18 covering the metallic layer 12 and connectors 16 on the ceramic support 10.

The metallic layer 12 has a multiplicity of pores 20 formed through the thickness thereof, as shown in FIG. 2. Namely, the pores 20 extend from the outer surface of the metallic layer 12 to the outer or bearing surface of the ceramic support 10. These pores 20 are filled with respective portions of the glass coating 18.

The multiplicity of pores 20 may be formed through the metallic layer 12, by suitable heat treatment of the above-indicated metallic film (12) applied to the outer surface of the ceramic support 10. Where the metallic film (12) is patterned into a spiral winding by laser trimming, the heat treatment for forming the pores 20 may be effected either before or after the trimming process of the metallic film.

When the pores 20 are formed through the metallic layer 12 by heat treatment, the size and density of the pores 20 may be suitably determined by adjusting the conditions (temperature and time) of the heat treatment effected on the metallic layer 12. It is generally recognized that the higher the heat treatment temperature and the longer the heat treatment time, the larger the size of the pores 20 formed, and the higher the density of the pores 20.

The present inventors conducted heat treatment experiments under different conditions on four specimens of a 5000A-thick platinum layer 12, each of which is formed by sputtering on the outer surface of the ceramic support 10 formed of alumina. More specifically, the specimens were heat-treated at 900° C., for 10 minutes, 30 minutes, 1 hr. and 2 hrs., respectively, and thereby given respective sets of pores 20 as indicated in FIGS. 3(*a*), 3(*b*), 3(*c*) and 3(*d*), respectively, which have different sizes and densities. It will be understood from the results as shown in FIGS. 3(*a*)–3(*d*) 3(*d*) that the pores 20 thus formed have a larger size and a higher density as the heating time increases, provided that the heating temperature is constant. This means that the size and density of the pores 20 may be adjusted by changing the heating time.

The size and density of the pores 20 formed through the metallic layer 12 should be determined such that the area of each pore 20 is not smaller than the area of a circle having a diameter of 1μm, and such that the average spacing between the adjacent pores 20 is not larger than 5μm. Of the four specimens of FIGS. 3(*a*) through 3(*d*), the platinum layers 12 as shown in FIGS. 3(c) and 3(d) satisfy the above requirements, and thus may be advantageously used for the resistor element of the present invention.

After forming the metallic layer 12 on the ceramic support 10, the glass coating 18 is formed on the outer surface of the metallic layer 12 with the pores 20 of the above-specified size and density. During the formation of the glass coating 18, residual air which is trapped between the metallic layer 12 and the ceramic support 10 effectively escapes through the pores 20, upon heating the applied glass material for fusion to form the coating 18. As a result, the metallic layer 12 may be sintered while being held in close contact with the ceramic support 10, assuring a significantly increased bonding strength between the metallic layer 12 and the support 10.

If the area of each pore 20 of the metallic layer 12 is smaller than that of a circle having a diameter of 1μm, residual air is unlikely to pass through the pores 20, because of the surface tension of the residual air. If the average spacing between the adjacent pores 20 is larger than 5μm, it is different for residual air to reach the pores 20 in direction perpendicular to the thickness of the metallic layer 12, and the residual air is less likely to escape from between the metallic layer 12 and the ceramic support 10. It follows that the escape of residual air is achieved more effectively as the size of the pores 20 is increased, or as the average spacing between the adjacent pores 20 is reduced. However, if the size of the pores 20 is excessively large, or if the average spacing between the pores 20 is excessively small, the metallic layer 12 assumes a net-like form, and is given a significantly increased electrical resistance. In view of this situation, the size and density of the pores 20 should be determined, depending upon the thickness of the layer 12, and the required resistance value or other properties of the resistor element which is used for a particular purpose.

As described above, the pores 20 formed through the metallic layer 12 are filled with the portions of the glass coating 18, such that the glass coating 18 is anchored in direct contact with the ceramic support 10 through the pores 20. Since the glass coating 18 and the ceramic support 10 are both formed of oxides, and thereby exhibit a comparatively high affinity for each other, the glass coating 18 can be firmly anchored to the ceramic support 10 with considerably high bonding strength.

The glass coating 18 firmly adheres to the ceramic support 10, at its portions within the multiplicity of pores 20 formed through the metallic layer 12 with a sufficiently small average spacing of not larger than 5μm. Therefore, the glass coating 18 is effectively prevented from being repelled from the metallic layer 12 during the formation of the coating 18, whereby the entire surface area of the metallic layer 12 is surely covered with the glass coating 18.

Further, the metallic layer 12 is sandwiched by and between the glass coating 18 and the ceramic support 10 which are firmly bonded to each other through the pores 20. In this respect, too, the bonding strength between the metallic layer 12 and the ceramic support 10 is greatly increased.

While the present invention has been described in its presently preferred embodiment for illustrative purpose only, it is to be understood that the invention is not limited to the details of the illustrated embodiment, but the invention may be embodied with various changes, modifications and improvements which may occur to those skilled in the art, without departing from the spirit and scope of the invention.

The specific construction of the resistor element of the present invention is not limited to that of the illustrated embodiment. Rather, the present resistor element may have various known constructions or arrangements. For example, the resistor element may include a planar support made of alumina, and at least one electrically resistor body formed on one or both of the opposite major surfaces of the planar support, each resistor body being a thin layer formed in a zigzag fashion, for example.

Further, the conditions of the heat treatment for forming the pores 20 in the metallic layer 12, i.e., the heating temperature and time, are by no means limited to the specific values as indicated in the illustrated embodiment, but may be suitably determined depending upon the size and density of the pores 20 to be formed, or upon the required resistance value and other properties of the resistor element to be obtained.

Moreover, the method for forming the pores 20 in the metallic thin layer 12 is never limited to the heat treatment as described in the illustrated embodiment. For example, a multiplicity of granules made of a material which burns out or sublimes upon application of heat are applied to the outer surface of the ceramic support 10 with an appropriate density, and then the metallic layer 12 is formed on the outer surface of the support 10 with the deposited granules. Thereafter, the granules are burned out or sublimated by heat application, whereby the metallic layer 12 is formed with pores corresponding to the granules which have disappeared.

What is claimed is:

1. A resistor element for determining a parameter, comprising:

a ceramic support having a bearing surface;

an electrically resistive metallic layer formed on said bearing surface of said ceramic support, said metallic layer having a plurality of pores which extend from an outer surface of said metallic layer to said bearing surface of said ceramic support, each of said pores having an area which is not smaller than that of a circle having a diameter of 1μm, an average spacing between adjacent ones of said pores being not larger than 5μm; and a glass coating covering said metallic layer.

2. A resistor element according to claim 1, wherein said metallic layer is formed of platinum.

3. A resistor element according to claim 1, wherein said pores are filled with portions of said glass coating, whereby said glass coating is anchored to said ceramic support.

4. A resistor element according to claim 1, wherein said ceramic support is formed of alumina.

5. A resistor element according to claim 1, wherein said ceramic support consists of a cylindrical member which has a circumferential outer surface as said bearing surface on which said metallic layer is formed.

6. A resistor element according to claim 5, wherein said metallic layer is formed in a spiral pattern on said circumferential outer surface of said ceramic support.

7. A resistor element according to claim 5, further comprising conductor means electrically connected to said metallic layer, and wherein said cylindrical member further has a bore formed therethrough, said conductor means consisting of two conductors whose end portions are inserted into open end portions of said bore.

8. A resistor element according to claim 7, further comprising two connectors for connecting opposite ends of said metallic layer to said two conductors, respectively.

* * * * *